United States Patent [19]

Emms

[11] Patent Number: 4,515,572

[45] Date of Patent: May 7, 1985

[54] FLOATABLE TOYS

[75] Inventor: Norman R. Emms, Codicote, England

[73] Assignee: Hestair Kiddicraft Limited, Surrey, England

[21] Appl. No.: 608,303

[22] Filed: May 8, 1984

[30] Foreign Application Priority Data

May 12, 1983 [GB] United Kingdom ..... 8313140

[51] Int. Cl.[3] ..... A63H 23/00

[52] U.S. Cl. ..... 446/153; 446/176

[58] Field of Search ..... 446/153, 154, 156, 161, 446/176, 199, 431

[56] References Cited

U.S. PATENT DOCUMENTS

| | | | |
|---|---|---|---|
| 1,675,522 | 7/1928 | Weidinger et al. | 446/153 |
| 2,405,715 | 8/1946 | Sabini | 446/161 |
| 2,932,916 | 4/1960 | Strickland | 446/156 |
| 3,129,528 | 4/1964 | Gausewitz | 446/153 |
| 3,773,015 | 11/1973 | Cruickshank et al. | 446/153 |
| 4,223,474 | 9/1980 | Strauss | 446/431 |
| 4,241,535 | 12/1980 | Tsukuda | 446/156 |
| 4,268,989 | 5/1981 | Wickham | 446/153 |

*Primary Examiner*—Robert A. Hafer
*Assistant Examiner*—Daniel Nolan
*Attorney, Agent, or Firm*—Pollock, Vande Sande and Priddy

[57] ABSTRACT

A floatable toy has a hollow body formed as the body of a frog or other figure. In the base of the body a series of apertures are formed through which water can enter the body. Corresponding apertures are formed in the head of the body for the escape of air. Floatation members in the form of eyeballs are trapped within the body. On immersing the body in water the water rises within the body and the floatation members rise and are retained in eye sockets in the head where they are visible while the body floats in a partially submerged condition.

8 Claims, 6 Drawing Figures

FLOATABLE TOYS

This invention relates to floatable toys and is particularly, but not exclusively, concerned with floatable toys in the form of figures of a factual or fictional creature, person or animal.

According to the present invention there is provided a floatable toy comprising a hollow body having trapped therein a movable floatation member, the hollow body being formed with spaced apertures to let water and air pass into and out of the body, the arrangement being such that on immersing the hollow body in water the water rises within the body and the floatation member rises and is retained by the body so that the body floats in a partially submerged condition with the floatation member retained in the region of an upper portion of the hollow body.

Preferably the hollow body is formed internally so as to define the position of the floatation member in the partially submerged condition of the body. The floatation member is preferably visible in the partially submerged condition of the hollow body. The hollow body may be formed with a socket to receive the floatation member. The arrangement may be such that when the floatation member is received in the socket, a portion of the floatation member projects through the socket and is visible.

Preferably the floatation member is spherical or generally spherical in form.

The hollow body may be partially or wholly transparent. The hollow body may be in the form of a figure provided with eye sockets to receive two floatation members in the form of eyeballs. Said dye sockets may be provided with portions to represent pupils for the eyeballs formed by the floatation members.

The apertures formed in said hollow body may include a set of three or more apertures grouped so that when the toy is lifted from the water after use a spray of water emerges from the apertures.

The invention also provides any concept or feature or combination of features disclosed, described or illustrated in this application.

Embodiments of the invention will now be described by way of example with reference to the accompanying drawings in whcih:

Figure 1:
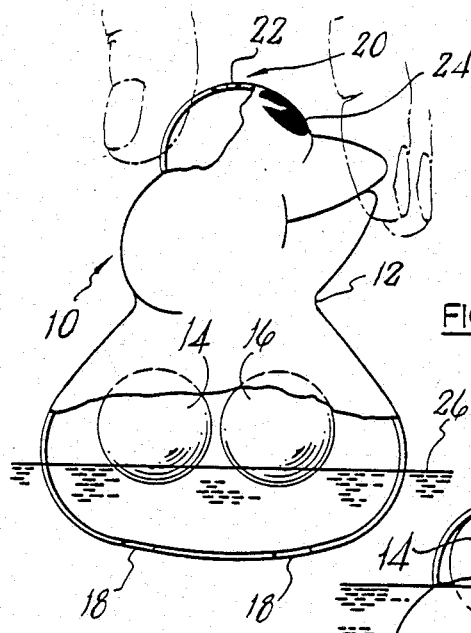
FIG. 1 shows a floatable toy in the form of a figure of a frog, in the process of being partially submerged in water.
Figure 2:
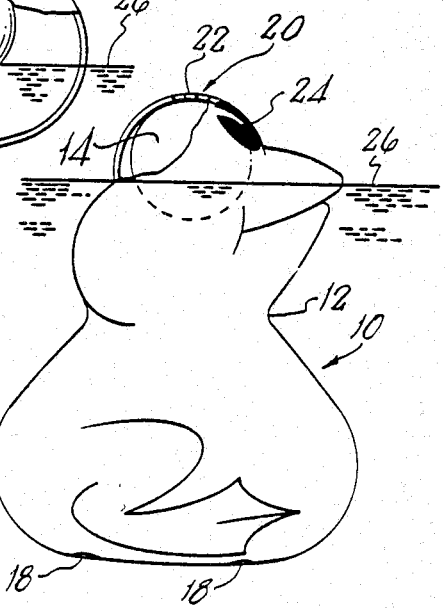
FIG. 2 shows the frog of FIG. 1 in the condition in which the body of the frog is substantially full of water and the figure floats by virtue of two floatation members consituting eyeballs.

As shown in FIGS. 1 and 2, a floatable toy 10 comprises a hollow body 12 having trapped therein two movable floatation members 14, 16 in the form of generally spherical or round eyeballs.

In this embodiment hollow body 12 is formed as the body of a frog. In the base of body 12 are formed a series of apertures 18 through which water can enter the body. Corresponding apertures 20 are formed in the upper or head portion of body 12 for the escape of air as the water rises.

Body 12 is formed from transparent semi-rigid plastics material such as polypropylene, and in the region of apertures 20 is formed with two generally domed shaped eye sockets 22.

Floatation members 14 are in the form of balls proportioned to fit into the eye sockets 22 so as to constitute eyeballs. The eyeballs may be painted any suitable color for the purpose and eye sockets 22 of hollow body 12 are provided with circular colored areas 24 to constitute pupils in relation to the eyeballs.

In use, the user immerses the toy 10 in the water 26 as shown in FIG. 1. The water enters through apertures 18 and eyeballs 14 rise within the hollow body while air escapes through the apertures 20. When the water level reaches the head region of the frog, the eyeballs lodge in the eye sockets 22, cooperating with the pupils 24 so as to give the toy a novel appearance. Moreover, the eyeball floatation members serve to retain the toy in the floating position shown in FIG. 2 when released. When the toy is raised from the water the water escapes through apertures 18 in the base of the figure forming a spray which is pleasing to a child.

Figure 3:
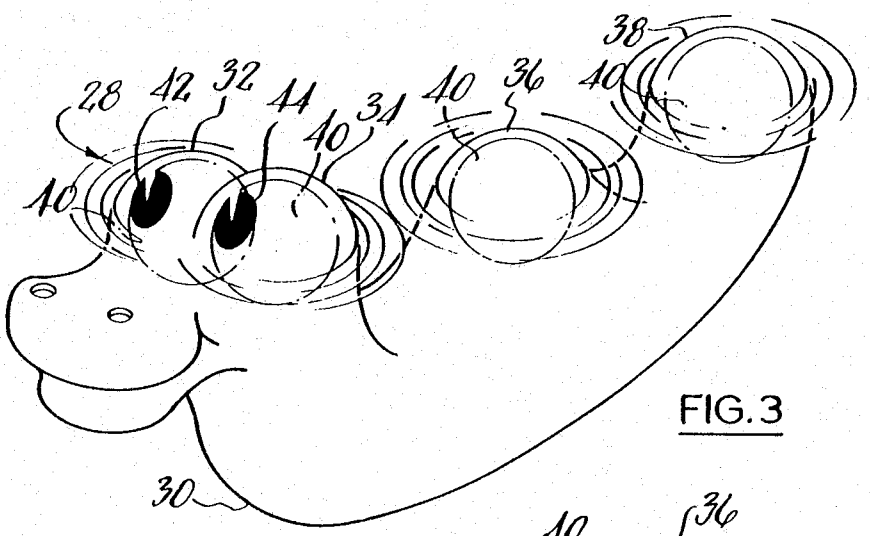
FIG. 3 show a perspective view of a further embodiment in the form of a figure of a Loch Ness monster.

In the embodiment of FIG. 3, a floatable toy in the form of a Loch Ness monster 28 comprises a hollow body portion 30 of transparent plastics material and formed with eye sockets 32, 34 and body humps 36, 38.

Four floatation members 40 are movable located within body portion 30 and apertures for the entry and exit of water and air are formed in the base of body portion 30 and adjacent eye sockets 32, 34 and body humps 36, 38 in a fashion similar to that of the preceding embodiment.

Pupils 42, 44 are painted on the head portion of the Loch Ness monster to cooperate with the two floatation members 40 associated with the eye sockets 32, 34.

Figure 4:
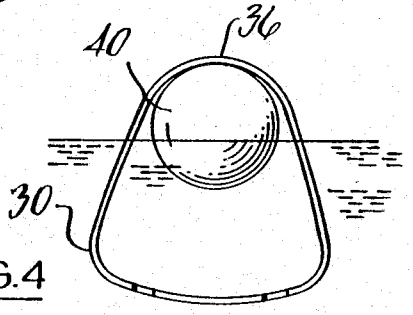
FIG. 4 shows a section through the body of the Loch Ness monster of FIG. 3.

FIG. 4 shows a cross-section through body portion 30 at body hump 36 showing the floatation member 40 in its raised position in which it cooperate with the other floatation members in retaining the toy in the partially submerged condition shown in FIG. 3.

Figure 5:
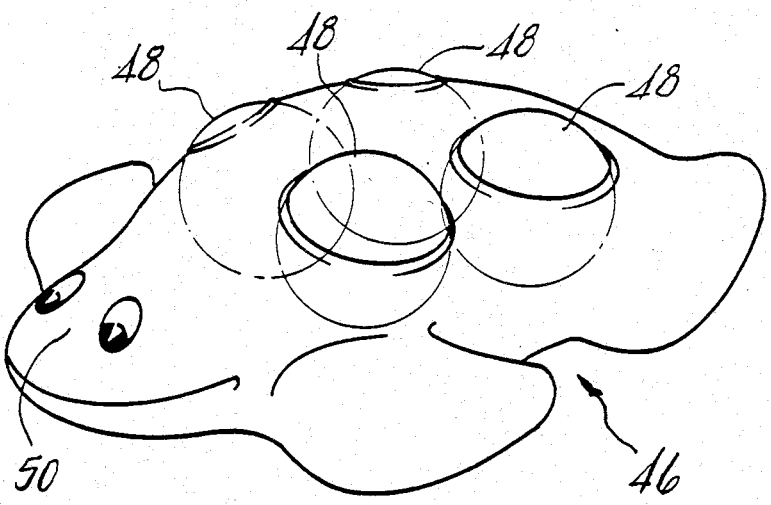
FIG. 5 shows a further embodiment in the form of a tortoise.

FIG. 5 shows a further embodiment in the form of a tortoise or turtle 46 having floatation members 48 which cooperate with body portion 50 of the tortoise in a manner similar to the floatation members of the preceding embodiments.

As an alternative to the retention of the floatation members by the transparent plastic material, the body portion could be formed with open sockets proportioned so as to receive and retain the floatation members with the latter projecting partially through the apertures. In this manner the invention is adaptable to the use of non-transparent materials for the body portion.

Figure 6:
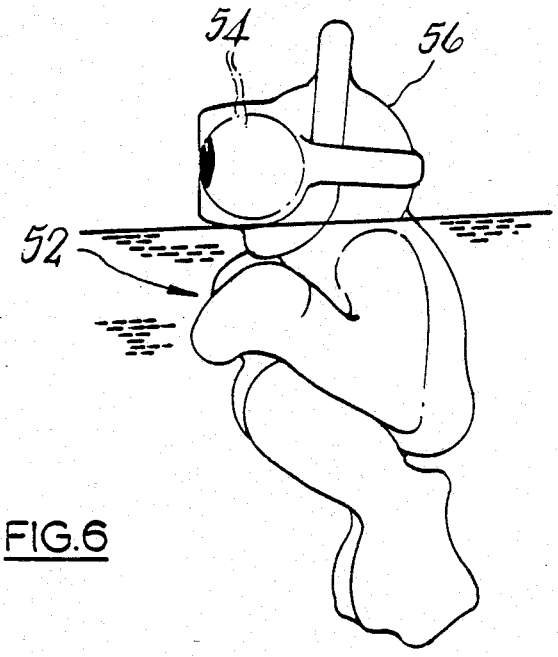
FIG. 6 shows a further embodiment in the form of a frogman.

In the embodiment of FIG. 6 a figure in the form of a frogman or diver 52 is likewise constructed in a manner similar to that of the preceding embodiments. The floatation members 54 are arranged so that in the partially submerged condition shown in FIG. 6 they are held in sockets in the head 56 of the frogman so as to project laterally outwardly, as shown.

Among modifications which could be made in the above embodiments while remaining within the scope of the invention are the use of non-spherical and indeed non-rounded floatation members, and the use of body portions which are in forms other than that of a figure. Moreover, the body portion could be arranged so as to have two or more selectable attitudes in the partially submerged condition in which the floatation members would serve to support the body portion.

I claim:

1. A floatable toy comprising a hollow body formed with spaced apertures to let water and air pass into and out of the body, and at least one movable floatation member located within said body, the arrangement being such that on immersing said hollow body in water the water rises within said body and said floatation member rises and is retained by the body to cause said body to float in a partially submerged condition with the said movable floatation member retained in the region of an upper portion of said hollow body, a hollow cavity being formed within said hollow body to define a socket in said upper portion of said hollow body which receives said floatation member in said partially submerged condition of said hollow body, said socket forming part of the body shape of the toy and being so constructed that said floatation member is visible when it is in said socket in said partially submerged condition of said hollow body.

2. The floatable toy of claim 1 wherein said socket is fabricated of a transparent or translucent material through which said floatation member is visible in said partially submerged condition of the hollow body.

3. The floatable toy of claim 1 wherein said socket has an opening therein, said floatation member when received in said socket having a portion which projects through said opening thereby to render said floation member visible from the exterior of said hollow body.

4. The floatable toy of claim 1 wherein said floatation member is generally spherical in form.

5. The floatable toy of claim 4 wherein said hollow body is substantially wholly transparent or translucent.

6. The floatable toy of claim 11 wherein said hollow body is in the form of a figure provided with two of said sockets in the form of eye sockets which receive two of said floatation members in the form of eyeballs.

7. The floatable toy of claim 6 wherein said eye sockets are provided with portions which represent pupils for the eyeballs formed by said floatation members.

8. The floatable toy of claim 1 wherein said apertures formed in said hollow body include a set of at least three apertures grouped together so that when the toy is lifted from the water after use a spray of water emerges from the interior of said hollow body via said group of apertures.

* * * * *